United States Patent [19]

Ryan

[11] Patent Number: 4,817,221

[45] Date of Patent: Apr. 4, 1989

[54] MULTIPURPOSE SURVIVAL TOOL

[76] Inventor: William W. Ryan, 717 NE. 8th St., Grants Pass, Oreg. 97526

[21] Appl. No.: 68,408

[22] Filed: Jul. 1, 1987

[51] Int. Cl.[4] ..... B25F 1/00

[52] U.S. Cl. ..... 7/148; 7/158; 7/159; 7/170; 30/123.7; 30/298; 30/308.3

[58] Field of Search ..... 7/158, 159, 167, 170, 7/148; 30/121, 123, 142, 144, 123.5, 123.7, 308.3, 308.1, 308, 296 R, 298

[56] References Cited

U.S. PATENT DOCUMENTS

| | | | |
|---|---|---|---|
| 1,455,621 | 5/1923 | Joyner | 30/298 |
| 1,457,930 | 6/1923 | Nelems . | |
| 2,359,098 | 9/1944 | Engle | 30/144 |
| 2,611,181 | 9/1952 | Coulter . | |
| 2,938,267 | 5/1960 | Tupper | 30/142 |
| 3,187,354 | 6/1965 | Frisbie . | |
| 3,593,419 | 7/1971 | Hula | 30/142 |
| 3,845,798 | 11/1974 | Palumbo | 30/308.1 |
| 4,363,147 | 12/1982 | Deweese . | |

FOREIGN PATENT DOCUMENTS

| | | | |
|---|---|---|---|
| 1882 | of 1896 | United Kingdom | 30/308 |

*Primary Examiner*—Roscoe V. Parker

*Attorney, Agent, or Firm*—Fleit, Jacobson, Cohn & Price

[57] ABSTRACT

A multipurpose tool particularly suitable for use by woodsmen comprising a blade portion which can be gripped in the hand and used as a hand tool for various purposes such as sawing, cutting, bottle or can opening, and wire stripping. The tool also includes an elongate slotted handle portion which fits between laterally projecting guide members secured to the blade portion so that when the blade and handle portions are attached together, the tool can be used as a hatchet.

4 Claims, 1 Drawing Sheet

MULTIPURPOSE SURVIVAL TOOL

BACKGROUND OF THE INVENTION

1. Field of the Invention

This invention relates to a multipurpose tool for use, for example, by woodsmen who may require a compact tool suitable for performing diverse functions. More particularly, the invention provides a multipurpose tool comprising a hatchet blade and handle which can be assembled to form a hatchet and which can be detached for use of the hatchet blade for other functions.

2. Information Disclosure Statement

Applicant acknowledges the following U.S. patents pertaining to multipurpose tools, none of which disclose a tool having the features of the present invention.

U.S. Pat. Nos. Des. 120,609; Des. 210,141; Des. 262,731; 2,230,376; 3,599,255; 3,623,173; 3,845,798.

SUMMARY OF THE INVENTION

An object of the present invention is to provide a multipurpose tool in the form of a blade having a sharp arcuate edge with sawteeth at one end portion thereof and means for performing at least one further operation with the blade also including a unique arrangement of finger openings and guide members to facilitate secure and stable gripping of the blade.

Another object of the invention utilizes the guide members on the blade as handle guides on its opposite surfaces to define a region which may be fitted into the slotted end of an elongate handle for securing the blade and handle together with the finger openings located between said guide members and the sharpened edge of the blade so that, when detached from the handle, the blade may be gripped in the hand by inserting the fingers through said openings, with the guide members forming the guides resting in the palm and together with the finger openings providing a comfortable secure handgrip for the blade.

The tool is readily convertible between its different functions by simple attachment or detachment of the elongate handle, and provides a useful adjunct to a woodsman's equipment.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF PREFERRED EMBODIMENT

Figure 1:
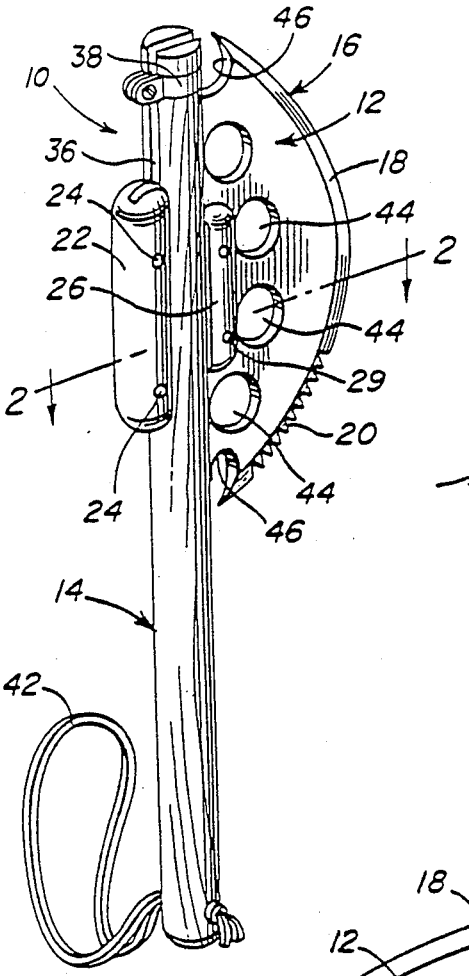
FIG. 1 is a perspective view of the multipurpose woodsman's tool in accordance with the invention.
Figure 2:
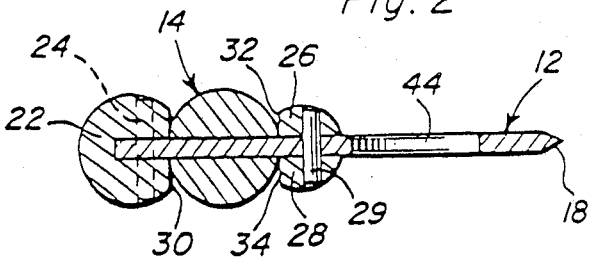
FIG. 2 is a sectional view, on an enlarged scale, taken on line 2—2 of FIG. 1.

A multipurpose woodsman's tool 10 (FIG. 1) comprises a hatchet blade portion 12 and a detachable elongate handle portion 14. With the blade and handle portions assembled as shown in FIG. 1, the tool is suitable for use as a hatchet, but the handle portion may be removed and the blade portion may be used per se for diverse other purposes as will be described and as illustrated in FIG. 5.

The blade portion may be a plate formed from conventional hardened steel, and has an arcuate cutting edge 16, the major portion 18 of which forms a smooth cutting edge, and the minor portion of which is formed with sawteeth 20. At the generally straight rear edge portion of the blade portion, a brass guide member 22 of part-circular cross section is affixed to the blade portion by rivets 24. Further brass guide members 26, 28 are fixed by rivets 29 to the blade portion at a spacing from guide member 22 conforming to the thickness of handle portion 14. The respective guide membes have flat facing surfaces 30, 32, 34, respectively, and arcuate outer surfaces.

Figure 4:
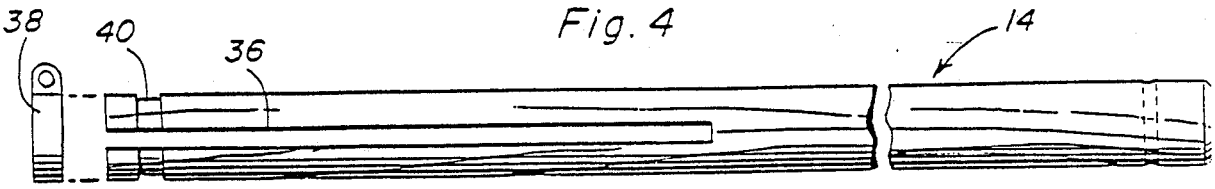
FIG. 4 is a plan view of an elongate handle portion of the tool.

Handle portion 14 is elongate and has a slot 36 at one end (FIG. 4) enabling the handle portion 14 to slide onto the blade portion between the guide members. The handle portion then may be tightly secured in place by a hose clamp 38 fitting in a groove 40 around the end of the handle portion. When using the tool as a hatchet, the guide members provide support and impact resistance for the handle portion. The handle portion may be provided with a wrist cord 42.

Figure 5:
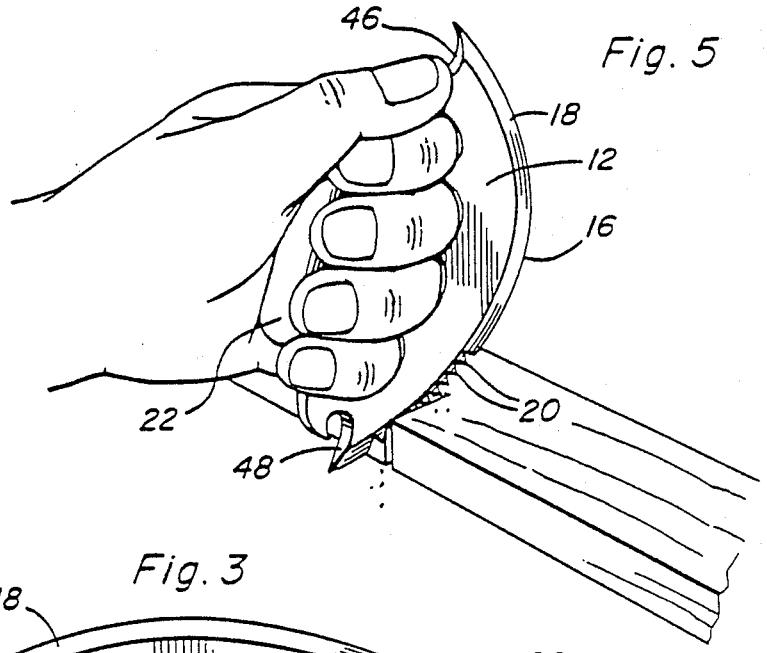
FIG. 5 is a perspective view showing the blade portion of the tool being used as a saw.
Figure 3:
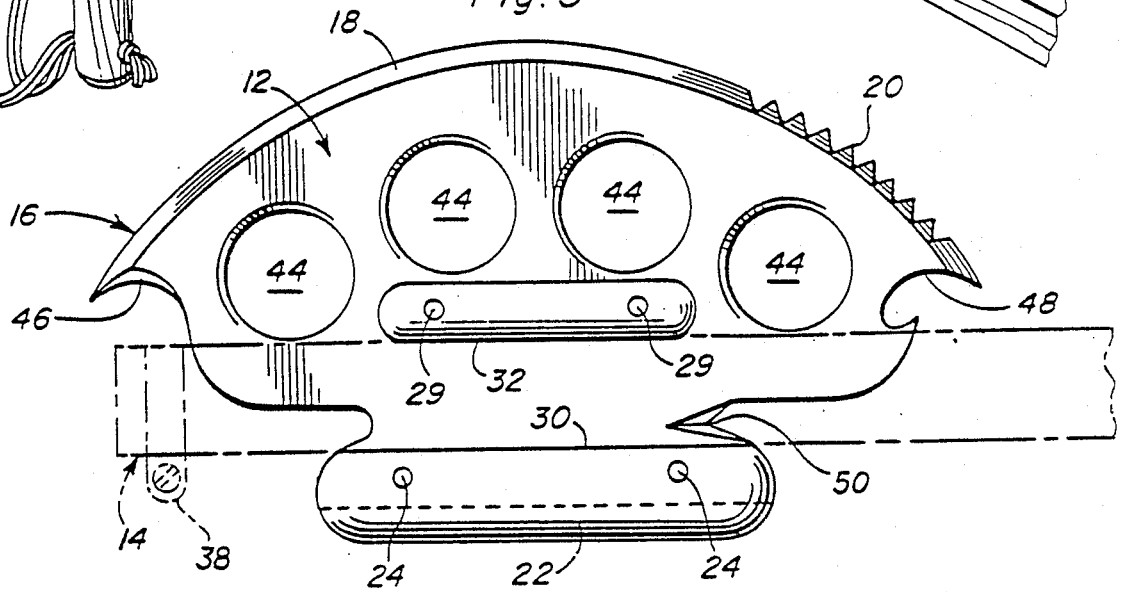
FIG. 3 is an elevational view of a blade portion of the tool.

Blade portion 12 further includes four finger openings 44 located between the cutting edge 16 and the guide members 22, 26 and 28, the finger openings and guide members together defining an alternative handle for the blade portion when the elongate handle portion 14 is removed, enabling the blade portion to be gripped in the hand as shown in FIG. 5 and the sawteeth 20 used for sawing and the smooth portion 18 of cutting edge 16 used for various cutting purposes, with the guide members being received in the user's palm.

Blade portion 12 is further provided with a curved and pointed back cutting edge 46 at one end of the cutting edge 16, useful, for example, for skinning animals, a can and bottle opening profile 48 at the other end of cutting edge 16, and a sharpened wire stripping notch 50 between the guide members, all of these items being usable when the elongate handle and blade portions are detached. The endmost finger openings 44 are disposed outwardly of the ends of guide members 26, 28 so that the endmost fingers on the hand can engage flat opposed surfaces of the plate forming the blade portion with the two middle fingers securely gripping all the guide members as illustrated in FIG. 5 in order to provide secure gripping of the tool during manipulation.

It will be appreciated from the foregoing that the invention accordingly provides a readily convertible and easily transported multipurpose tool forming a convenient and useful adjunct to a woodsman's equipment.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A hand held and manipulated tool comprising an elongate, generally flat plate having an arcuate cutting edge extending substantially from end to end thereof, said plate including a generally straight edge in opposed relation to the cutting edge, a generally longitudinally straight guide member along the straight edge and including a rounded external surface to engage the palm of a hand of a user, said plate including a plurality of longitudinally spaced, finger-receiving openings in spaced relation to the cutting edge and guide member thereby enabling individual fingers to cooperate with the plate openings and combine with the guide member to form a handgrip for securely holding the tool during use, said cutting edge including one length portion having a smooth bevelled knife edge extending from one end of the cutting edge and a second length portion having a sawtoothed edge extending from the other end of the cutting edge, said knife edge being substantially longer than the sawtoothed edge, said openings having their centers arcuately arranged and substantially equally spaced from the arcuate cutting edge, a second guide member spaced from the guide member along the straight edge of the plate and in parallel relation thereto, each of said guide members projecting laterally from both surfaces of the plate and facilitating gripping engagement of the tool, the endmost openings being disposed longitudinally outwardly of the ends of the second guide member whereby the fingers received in the endmost openings can engage the surface of the plate outwardly of the ends of the second guide member to stabilize the plate with respect to the hand of the user when using the tool in a manner that forces are exerted along the length of the cutting edge.

2. The tool as defined in claim 1 together with an elongate handle having a longitudinal slot extending inwardly from one end thereof, said slot slidably receiving said plate therein and clamp means at the outer end of the slot to close the slot into clamping engagement with said plate to form a hatchet, said handle extending between and in guiding engagement with the guide members for stabilizing the handle and plate when used as a hatchet.

3. The tool as defined in claim 2 wherein said plate includes a wire stripping notch and a bottle opening means in one end edge thereof and an animal skinning and gutting hook on the other end thereof.

4. A hand held and manipulated tool comprising an elongate, generally flat plate having an arcuate cutting edge extending substantially from end to end thereof, said plate including a generally straight edge in opposed relation to the cutting edge, a generally longitudinally straight guide member mounted on the plate along the straight edge and including a rounded external surface to engage the palm of a hand of a user, said plate including a plurality of longitudinally spaced, finger-receiving openings in spaced relation to the cutting edge and guide member thereby enabling individual fingers to cooperate with the plate openings and combine with the guide member to form a handgrip for securely holding the tool during use, said openings having their centers arcuately arranged and subtantially equally spaced from the arcuate cutting edge, a second guide member mounted on said plate and spaced from the guide member along the straight edge of the plate and in parallel relation thereto, each of said guide members projecting laterally from both surfaces of the plate and facilitating gripping engagement of the tool, the endmost openings being disposed longitudinally outwardly of the ends of the second guide member whereby the fingers received in the endmost openings can engage the surface of the plate outwardly of the ends of the second guide member to stabilize the plate with respect to the hand of the user when using the tool in a manner that forces are exerted along the length of the cutting edge.

* * * * *